US005431550A

United States Patent [19]

Otake

[11] Patent Number: 5,431,550

[45] Date of Patent: Jul. 11, 1995

[54] HERMETIC MOTOR DRIVEN SCROLL APPARATUS HAVING IMPROVED LUBRICATING MECHANISM

[75] Inventor: Shinichi Otake, Isesaki, Japan

[73] Assignee: Sanden Corporation, Isesaki, Japan

[21] Appl. No.: 288,022

[22] Filed: Aug. 10, 1994

[30] Foreign Application Priority Data

Sep. 14, 1993 [JP] Japan ..... 5-250927

[51] Int. Cl.[6] ..... F01C 1/04; F01C 17/06; F01C 21/04

[52] U.S. Cl. ..... 418/55.5; 418/55.6; 418/94; 418/100; 418/151

[58] Field of Search ..... 418/55.1, 55.5, 55.6, 418/57, 94, 100, 151

[56] References Cited

U.S. PATENT DOCUMENTS

| | | | |
|---|---|---|---|
| 4,343,599 | 8/1982 | Kousokabe | 418/55.6 |
| 4,496,293 | 1/1985 | Nakamura et al. | 417/371 |
| 4,564,339 | 1/1986 | Nakamura et al. | 417/366 |
| 4,666,381 | 5/1987 | Butterworth | 418/55.6 |
| 4,877,381 | 10/1989 | Johnson et al. | 418/55.6 |
| 4,900,238 | 2/1990 | Shigemi et al. | 418/149 |
| 4,932,845 | 6/1990 | Kikuchi et al. | 418/55.6 |
| 4,936,756 | 6/1990 | Shimizu et al. | 418/100 |
| 4,949,396 | 7/1990 | Shimizu et al. | 417/902 |
| 4,968,232 | 11/1990 | Kikuchi | 418/55.5 |
| 5,000,669 | 3/1991 | Shimizu et al. | 418/1 |

FOREIGN PATENT DOCUMENTS

| | | |
|---|---|---|
| 0317900 | 11/1988 | European Pat. Off. . |
| 54-139107 | 10/1979 | Japan . |
| 56-156490 | 12/1981 | Japan . |
| 58-172487 | 10/1983 | Japan . |
| 60-93192 | 5/1985 | Japan . |
| 61-87994 | 5/1986 | Japan . |
| 1301972 | 12/1989 | Japan . |

*Primary Examiner*—John J. Vrablik
*Attorney, Agent, or Firm*—Baker & Botts

[57] ABSTRACT

A lubricating mechanism for a motor driven scroll apparatus has the compression and drive mechanisms within a hermetically sealed housing. The drive mechanism comprises a drive shaft having a pin member extending from an inner end thereof and a motor for rotating the drive shaft. The pin member is operatively connected to an orbiting scroll of the compression mechanism through a bushing. The drive shaft includes a first axial bore extending from an open end adjacent a fluid inlet port and terminating adjacent the inner end of the drive shaft. Radial bores are provided at the terminal end of the first axial bore. A second axial bore extends from the terminal end of the drive shaft. The longitudinal axis of the first axial bore is substantially aligned with the second axial bore. The bushing includes a passage extending substantially straight therethrough and substantially aligned with the open end of the second axial bore. In another embodiment, the bushing further includes a radial straight portion radially extending from a terminal end of the axial straight portion and is open at an outer peripheral surface of the bushing.

10 Claims, 4 Drawing Sheets

HERMETIC MOTOR DRIVEN SCROLL APPARATUS HAVING IMPROVED LUBRICATING MECHANISM

BACKGROUND OF THE INVENTION

1. Technical Field of the Invention

This invention relates to a hermetic motor driven scroll apparatus, and more particularly to a lubricating mechanism for the hermetic motor driven scroll apparatus.

2. Description of the Prior Art

Hermetic motor driven scroll apparatuses are generally well-known. For example, in FIG. 4 of U.S. Pat. No. 5,247,738 to Yoshii, there is shown a hermetic type motor driven scroll compressor. Referring to FIG. 1, which is substantially identical to FIG. 4 of U.S. Pat. No. 5,247,738 to Yoshii, there is shown an overall construction of a hermetic type motor driven scroll compressor. For purposes of explanation only, the left side of FIG. 1 will be referred to as the forward end or front of the compressor and the right side of FIG. 1 will be referred to as the rearward end or rear of the compressor.

The hermetic type motor driven scroll compressor 100 comprises a compressor housing 11, which houses a compression mechanism 20. Compression mechanism 20 is a scroll-type fluid compression mechanism. A drive mechanism 30 is also housed within housing 11. Housing 11 comprises cylindrical portion 111 and first and second cup-shaped portions 112 and 113. An open end of first cup-shaped portion 112 is releasably and hermetically connected to a front open end of cylindrical portion 111 by a plurality of bolts 12. An open end of second cup-shaped portion 113 is releasably and hermetically connected to a rear open end of cylindrical portion 111 by a plurality of bolts 13.

Scroll-type fluid compression mechanism 20 comprises fixed scroll 21 having circular end plate **21*a* and spiral element 2l*b*, which rearwardly extends from circular end plate 21*a*. Circular end plate 21*a* of fixed scroll 21 is fixedly disposed within first cup-shaped portion 112 by a plurality of bolts 14. Compression mechanism 20 further comprises orbiting scroll 22 having circular end plate 22*a* and spiral element 22*b*, which forwardly extends from circular end plate 22*a*. Spiral element 21*b* of fixed scroll 21 interfits with spiral element 22*b* of orbiting scroll 22** with an angular and radial offset.

Seal element 211 is disposed at an end surface of spiral element **21*b* of fixed scroll 21, thereby sealing the mating surfaces of spiral element 21*b* of fixed scroll 21 and circular end plate 22*a* of orbiting scroll 22. Similarly, seal element 221 is disposed at an end surface of spiral element 22*b* of orbiting scroll 22, thereby sealing the mating surfaces of spiral element 22*b* of orbiting scroll 22 and circular end plate 21*a* of fixed scroll 21. O-ring seal element 40 is elastically disposed between an outer peripheral surface of circular end plate 21*a* of fixed scroll 21 and an inner peripheral surface of first cup-shaped portion 112 to seal the mating surfaces therebetween. Circular end plate 21*a* of fixed scroll 21 partitions an inner hollow space of compressor housing 11 into discharge chamber 50 and suction chamber 60**.

Circular end plate **21*a* of fixed scroll 21 is provided with valved discharge port 21*c* axially formed therethrough so as to link discharge chamber 50 to a central fluid pocket (not shown), which is defined by fixed and orbiting scrolls 21 and 22. First cup-shaped portion 112 has cylindrical projection 112*a* forwardly projecting from a central region of an outer surface of a front end section thereof. Compressed refrigerant fluid is discharged from the central fluid pocket through valved discharge port 21*c* and into discharge chamber 50. Discharge chamber 50 is connected to an external cooling circuit (not shown) through axial hole 112*b*. Axial hole 112*b*, which functions as an outlet port of compressor 10, is formed through cylindrical projection 112*a*** so as to be connected to an inlet of an element (not shown), e.g., condenser of the external cooling circuit through a pipe member (not shown).

Drive mechanism 30 comprises drive shaft 31 and motor 32 for rotating drive shaft 31. Drive shaft 31 comprises pin member **31*a*, which forwardly extends from, and is integral with, a front end surface of drive shaft 31. An axis of pin member 31*a* is radially offset from an axis of drive shaft 31. Bushing 311 is rotatably disposed within annular projection 22*c*, which axially projects from a central region of the rear end surface of circular end plate 22*a* of orbiting scroll 22, through radial needle bearing 312. Bushing 311 includes a small cylindrical projection (not shown) which is formed at a rear end surface thereof. A longitudinal axis of the small cylindrical projection is radially offset from a longitudinal axis of bushing 311 by a predetermined distance, such as the radius of circular orbit which is created during the orbital motion of orbiting scroll 22. The small cylindrical projection of bushing 311 is loosely received within a small cylindrical depression (not shown) which is formed at the from end surface of drive shaft 31. Shallow depression 311*a* is formed at a front end surface of bushing 311. Balance weight 313 is fixedly disposed on a rearward extension of bushing 311 and serves to balance the torque of drive shaft 31. Pin member 31*a* is rotatably inserted in an axial hole 311*b* of bushing 311 to operatively connect pin member 31*a* to circular end plate 22*a* of orbiting scroll 22. The axis of hole 311*b* is radially offset from the axis of bushing 311. Relative axial movement between pin member 31*a* and bushing 311 is prevented by snap ring 314 which is fixedly mounted about a front end portion of pin member 31*a***.

Inner block 23 extends radially inwardly from, and is integral with, the front end of cylindrical portion 111 of compressor housing 11. Rotation preventing mechanism 24 is disposed between inner block 23 and circular end plate **22*a* of orbiting scroll 22 so that orbiting scroll 22 only orbits during rotation of drive shaft 31. Inner block 23 comprises a central hole 23*a* of which the longitudinal axis is aligned with the longitudinal axis of cylindrical portion 111. Bearing 25 is fixedly disposed within central hole 23*a* so as to rotatably support a front end portion of drive shaft 31. Inner block 23 partitions suction chamber 60 into first suction chamber section 61 rearward of inner block 23 and second suction chamber section 62 forward of inner block 23. A plurality of holes 35 are axially formed through inner block 23 to link first and second suction chamber sections 61 and 62**.

Second cup-shaped portion 113 comprises annular cylindrical projection **113*a* forwardly projecting from a central region of an inner surface of a rear end section thereof. The longitudinal axis of annular cylindrical projection 113*a* is aligned with the longitudinal axis of second cup-shaped portion 113. Bearing 26 is fixedly disposed within annular cylindrical projection 113*a* so as to rotatably support a rear end portion of drive shaft 31. Second cup-shaped portion 113 further comprises cylindrical projection 113***b* rearwardly projecting from a central region of an outer surface of the rear end section thereof. Axial hole 113*c*, which functions as an inlet port of compressor 10, is formed through cylindrical projection 113*b* and is connected to an outlet of another element (not shown), e.g., an evaporator of the external cooling circuit, through a pipe member (not shown). The longitudinal axis of axial hole 113*c* is aligned with the longitudinal axis of annular cylindrical projection 113*a*. A diameter of axial hole 113*c* is slightly smaller than an inner diameter of annular cylindrical projection 113*a*.

First annular cut-out section 15 is formed at an inner periphery of an open end surface of first cup-shaped portion 112 of compressor housing 11. Consequently, first annular projection 15*a* is formed at an outer periphery of the open end surface of first cup-shaped portion 112. The longitudinal axis of an inner periphery of first annular projection 15*a* is aligned with the longitudinal axis of first cup-shaped portion 112. Second annular cut-out section 16 is formed at an outer periphery of a front open end surface of cylindrical portion 111 of compressor housing 11. Consequently, second annular projection 16*a* is formed at an inner periphery of the front open end surface of cylindrical portion 111. The longitudinal axis of an outer periphery of second annular projection 16*a* is aligned with the longitudinal axis of cylindrical portion 111. By the above described construction, the open end of first cup-shaped portion 112 and the front open end of cylindrical portion 111 are connected to each other by a faucet joint. O-ring seal element 41 is elastically disposed at a rear end surface of first annular cut-out section 15 to seal the mating surfaces of first annular cut-out section 15 and second annular projection 16*a*.

Third annular cut-out section 17 is formed at an inner periphery of a rear open end surface of cylindrical portion 111 of compressor housing 11. Consequently, third annular projection 17*a* is formed at an outer periphery of the rear open end surface of cylindrical portion 111 of compressor housing 11. The longitudinal axis of an inner periphery of third annular projection 17*a* is aligned with the longitudinal axis of cylindrical portion 111. Fourth annular cut-out section 18 is formed at an outer periphery of an open end surface of second cup-shaped portion 113 of compressor housing 11. Consequently, fourth annular projection 18*a* is formed at an inner periphery of the open end surface of second cup-shaped portion 113. The longitudinal axis of the outer periphery of fourth annular projection 18*a* is aligned with the longitudinal axis of second cup-shaped portion 113. By the above-described construction, the open end of second cup-shaped portion 113 and the rear open end of cylindrical portion 111 are connected to each other by a faucet joint. O-ring seal element 42 is elastically disposed at a rear end surface of third annular cut-out section 17 to seal the mating surfaces of third annular cut-out section 17 and fourth annular projection 18*a*.

Drive shaft 31 further comprises first axial bore 31*b* axially extending therethrough. One end of first axial bore 31*b* is open at a rear end surface of drive shaft 31 so as to be adjacent to a front open end of axial bore 113*c*. The other end of first axial bore 31*b* terminates at a position which is behind bearing 25. A plurality of radial bores 31*c* are formed at a front terminal end of first axial bore 31*b* so as to link the from terminal end of first axial bore 31*b* to first suction chamber section 61. Second axial bore 31*d* axially extends from the front terminal end of first axial bore 31*b* and is open at a from end surface of pin member 31*a* of drive shaft 31. The diameter of second axial bore 31*d* is designed to be smaller than the diameter of first axial bore 31*b*. The longitudinal axis of second axial bore 31*d* is radially offset from the longitudinal axis of first axial bore 31*b*.

Annular cylindrical projection 113*d* rearwardly projects from a peripheral region of the outer surface of the rear end section of second cup-shaped portion 113. One portion of annular cylindrical projection 113*d* is integral with one portion of cylindrical projection 113*b*. An insulating base 27 having external power conductor terminals 27*a* is firmly secured to a rear end of annular cylindrical projection 113*d* by a plurality of bolts (not shown). O-ring seal element 43 is elastically disposed at a rear end surface of annular cylindrical projection 113*d* so as to seal the mating surfaces of insulating base 27 and annular cylindrical projection 113*d*.

Motor 32 includes annular-shaped rotor 32*a* fixedly surrounding an exterior surface of drive shaft 31 and annular-shaped stator 32*b* surrounding rotor 32*a* with a small radial air gap. Stator 32*b* axially extends along the rear open end region of cylindrical portion 111 and the open end region of second cup-shaped portion 113. Stator 32*b* is disposed between a first annular ridge 111*a* formed at an inner peripheral surface of cylindrical portion 111 and a second annular ridge 113*e* formed at an inner peripheral surface of second cup-shaped portion 113. The axial length of stator 32*b* is slightly smaller than an axial distance between first annular ridge 111*a* and second annular ridge 113*e*.

In a process of assembling compressor 100, stator 32*b* is fixedly secured to the rear open end region of cylindrical portion 111 and to the open end region of second cup-shaped portion 113 by a shrinkage fit technique. According to this technique, stator 32*b* is inserted into the rear open end region of cylindrical portion 111, until an outer peripheral portion of a front end surface of stator 32*b* is in contact with a side wall of first annular ridge 111*a*, or stator 32*b* is inserted into the open end region of second cup-shaped portion 113, until an outer peripheral portion of a rear end surface of stator 32*b* is in contact with a side wall of second annular ridge 113*e*.

In operation, refrigerant fluid flowing from an outlet of one external element (not shown), e.g., an evaporator, is conducted into axial hole 113*c* and then flows through first axial bore 31*b* of drive shaft 31. A portion of the refrigerant fluid in first axial bore 31*b* flows into first suction chamber section 61 through radial bores 31*c*, and then further flows into second suction chamber section 62 through holes 35 of inner block 23. The remainder of the refrigerant fluid in first axial bore 31*b* of drive shaft 31 flows through second axial bore 31*d*, and then flows into a hollow space 63 which is defined by circular end plate 22*a* of orbiting scroll 22, annular projection 22*c* and bushing 311. A portion of the refrigerant fluid in hollow space 63 flows to second suction chamber section 62 past the internal gaps of radial needle bearing 312, and the gaps created between radial needle bearing 312 and annular projection 22*c* and between radial needle bearing 312 and bushing 311. Therefore, the internal frictional surfaces between radial needle bearing 312 and annular projection 22*c* and the frictional surfaces between radial needle bearing 312 and bushing 311 are lubricated by, for example, lubricating oil suspended in the refrigerant fluid in a mist state. The remainder of the refrigerant fluid in hollow space 63 flows into second suction chamber section 62 past the small air gaps created between snap ring 314 and bushing 311, between pin member 31*a* and bushing 311, between bushing 311 and balance weight 313, and between balance weight 313 and the from end surface of drive shaft 31. Therefore, the frictional surfaces between snap ring 314 and bushing 311 and between pin member 31*a* and bushing 311 are lubricated by the lubricating oil which is suspended in the refrigerant fluid in a mist state.

The refrigerant fluid flowing through radial bores 31*c* and the refrigerant fluid flowing through second axial bore 31*d* are merged at second suction chamber section 62, and then are taken past the rotation prevention mechanism 24, then into the outer sealed-off fluid pockets defined by the fixed and orbiting scrolls 21 and 22. Therefore, the internal frictional surfaces of rotation preventing mechanism 24 are lubricated by the lubricating oil which is suspended in the refrigerant fluid in a mist state. The refrigerant fluid taken into the outer sealed-off fluid pockets travels centrally with decreasing volume thereof, e.g., with compression thereof, in accordance with an orbital motion of orbiting scroll 22. The compressed refrigerant fluid is then discharged into discharge chamber 50 through valved discharge port 21*c* of circular end plate 21*a* of fixed scroll 21. The refrigerant fluid in discharge chamber 50 flows through axial hole 112*b* to an inlet of another external element (not shown), e.g., a condenser.

According to the foregoing conventional compressor, second axial bore 31*d* axially extends from the front terminal end of first axial bore 31*b* such that the longitudinal axis of first axial bore 31*b* is located outside the longitudinal axis of the second axial bore 31*d*. Due to this arrangement, the refrigerant fluid inefficiently flows from the first axial bore 31*b* to the second axial bore 31*d* during operation of the compressor. Consequently, a relatively small amount of the lubricating oil is conducted into hollow space 63 through second axial bore 31*d*. As a result, the frictional surfaces between bushing 311 and the elements associated with the busing 311, such as pin member 31*a* and radial needle bearing 312, are sometimes insufficiently lubricated during operation of the compressor.

SUMMARY OF THE INVENTION

Accordingly, it is an object of the preferred embodiments to provide a hermetic motor driven scroll apparatus in which the frictional surfaces of the internal component parts associated with the drive mechanism are effectively and sufficiently lubricated.

In order to achieve the above and other objects of the preferred embodiments, there is provided a hermetic motor driven scroll apparatus comprising a housing having a fluid inlet port and a fluid outlet port. A compression mechanism is disposed within the housing. The compression mechanism includes a fixed scroll fixedly disposed within the housing and an orbiting scroll. The fixed scroll includes a first end plate from which a first spiral element extends and the orbiting scroll includes a second end plate from which a second spiral element extends. The first and second spiral elements interfit at an angular and radial offset to make a plurality of line contacts to define at least one pair of sealed off fluid pockets.

A drive mechanism is also disposed within the housing. The drive mechanism comprises a drive shaft having a first axial end and a second axial end opposite to the first axial end. The second axial end of the drive shaft is adjacent to the fluid inlet port. The drive shaft is rotatably supported by the housing through bearings. The drive mechanism further comprises a crank pin eccentrically extending from the first axial end of the drive shaft and a bushing having an axial hole into which the crank pin is rotatably received. The bushing operatively connects the crank pin to the orbiting scroll. The orbiting scroll is caused to move in orbital motion by the bushing.

The drive mechanism still further comprises a motor rotating the drive shaft. The motor includes a rotor fixedly disposed about the drive shaft and a stator fixedly secured to an interior surface of the housing so as to surround the rotor with a radial air gap. A rotation preventing device is provided within the housing between the compression mechanism and the drive mechanism for preventing the rotation of the orbiting scroll during its orbital motion.

The drive shaft includes a first axial bore formed therethrough. A second end of the first axial bore is open at the second axial end of the drive shaft. The first end of the first axial bore terminates at a position adjacent to the first axial end of the drive shaft. The first axial bore includes a longitudinal axis. The drive shaft further includes at least one radial bore which radially extends from the first end of the first axial bore and is open at an outer peripheral surface of the drive shaft.

The drive shaft still further includes a second axial bore which includes a longitudinal axis, and extends from the first end of the first axial bore and is open at an axial end surface of the first axial end of the drive shaft. The longitudinal axis of the first axial bore is substantially collinear with the longitudinal axis of the second axial bore.

The bushing further includes a first axial end and a second axial end opposite to the first axial end, and a passage formed therein. The second axial end of the bushing faces the first axial end of the drive shaft. The passage includes an axial straight portion having a longitudinal axis. One end of the axial straight portion of the passage is open at the second axial end of the bushing. The longitudinal axis of the axial straight portion of the passage is aligned with the longitudinal axis of the second axial bore.

In one preferred embodiment, the axial straight portion of the passage axially extends from the second axial end to the first axial end of the bushing.

In another preferred embodiment, the first end of the axial straight portion of the passage terminates at a position adjacent to the first axial end of the bushing. The passage further includes at least one radial straight portion, which radially extends from the first end of the axial straight portion of the passage through the axial hole formed in the bushing and terminates at an outer peripheral surface of the bushing.

These and other features and objects of the present invention will become apparent when the specification is read in conjunction with the accompanying drawings.

DETAILED DESCRIPTION OF THE PREFERRED EMBODIMENTS

Figure 1:
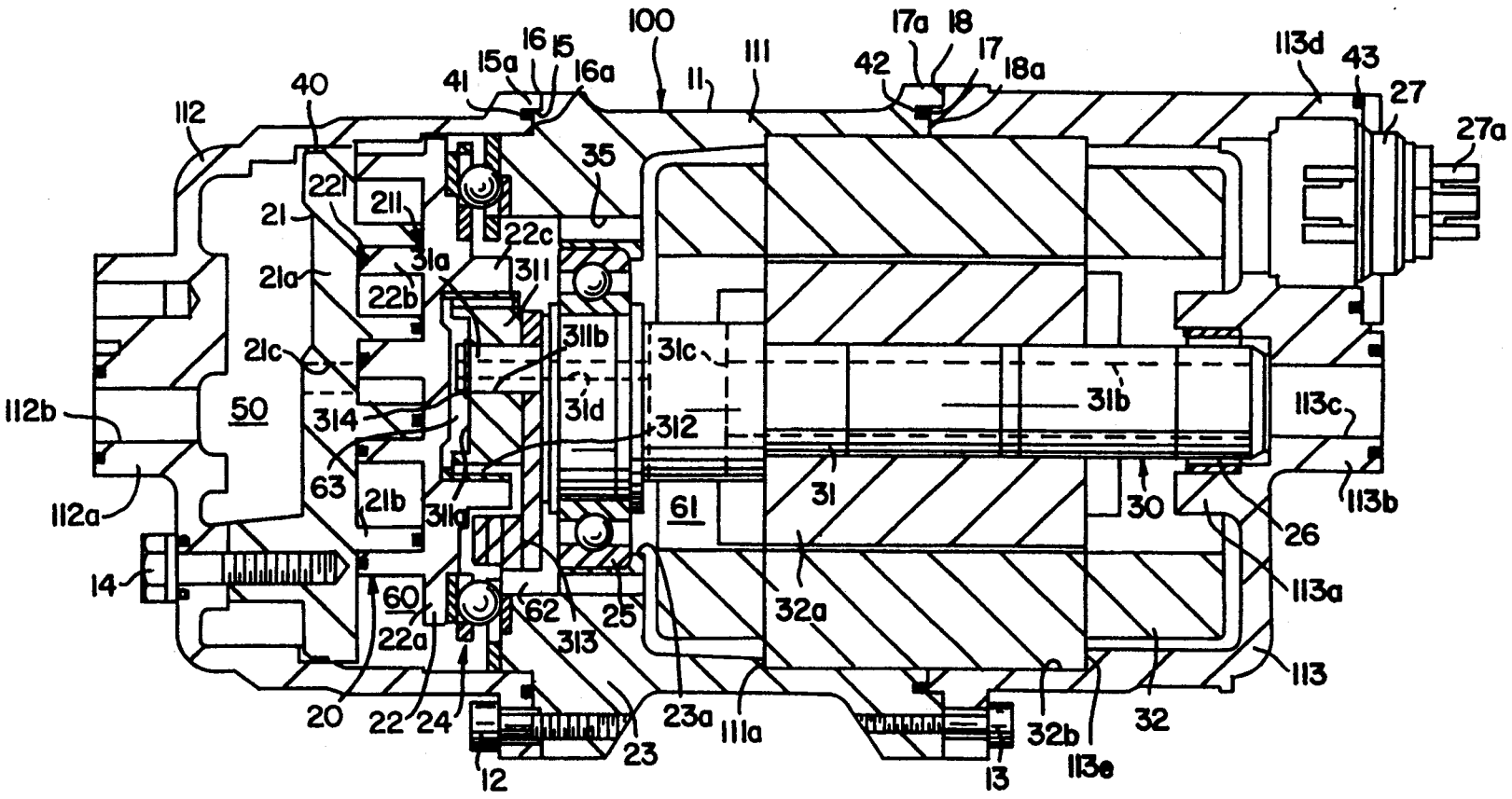
FIG. 1 PRIOR ART
FIG. 1 is a longitudinal sectional view of a hermetic type motor driven scroll compressor according to one prior art embodiment.
Figure 2:
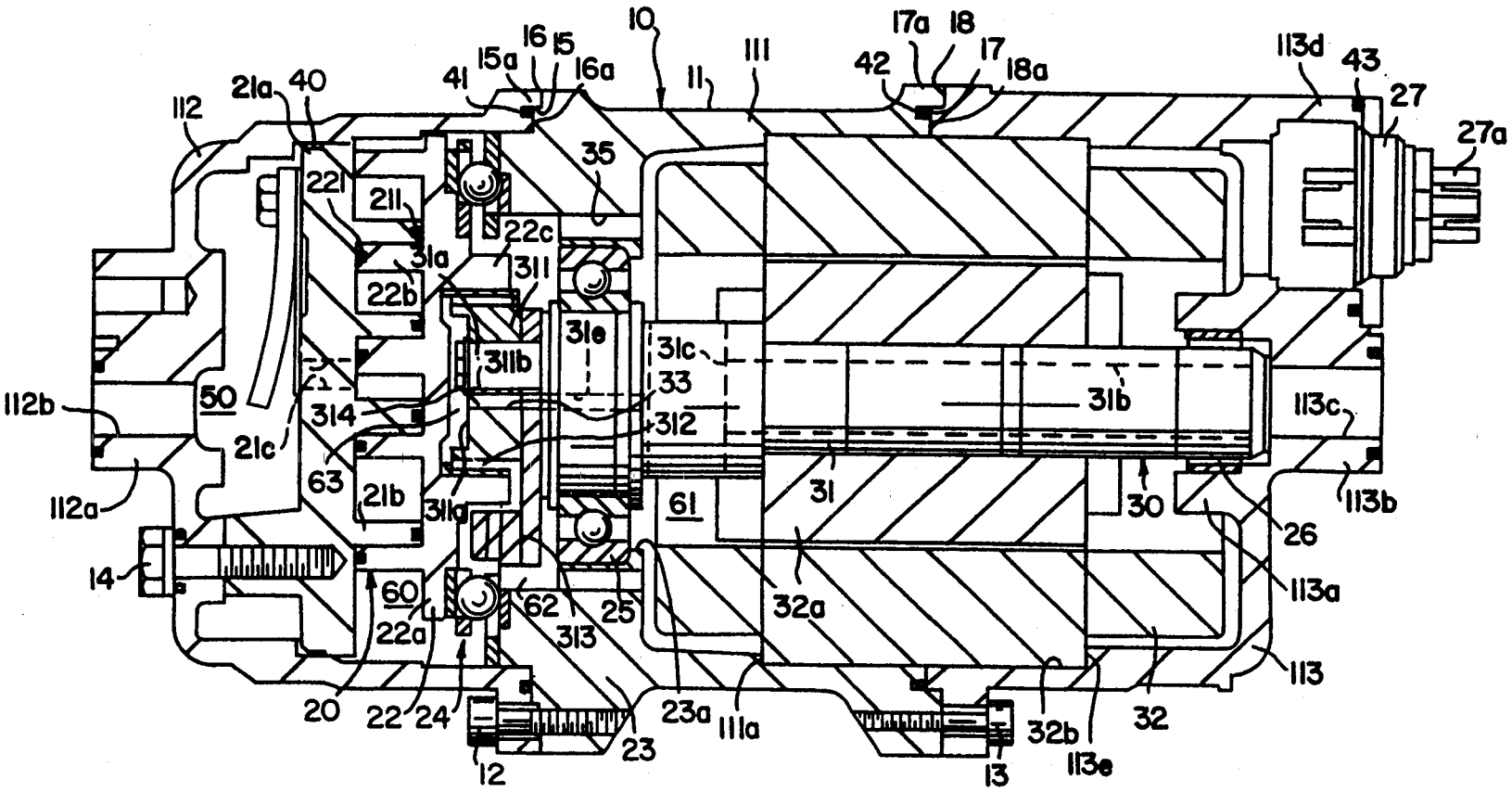
FIG. 2 is a longitudinal sectional view of a hermetic type motor driven scroll compressor according to a first preferred embodiment.
Figure 3:
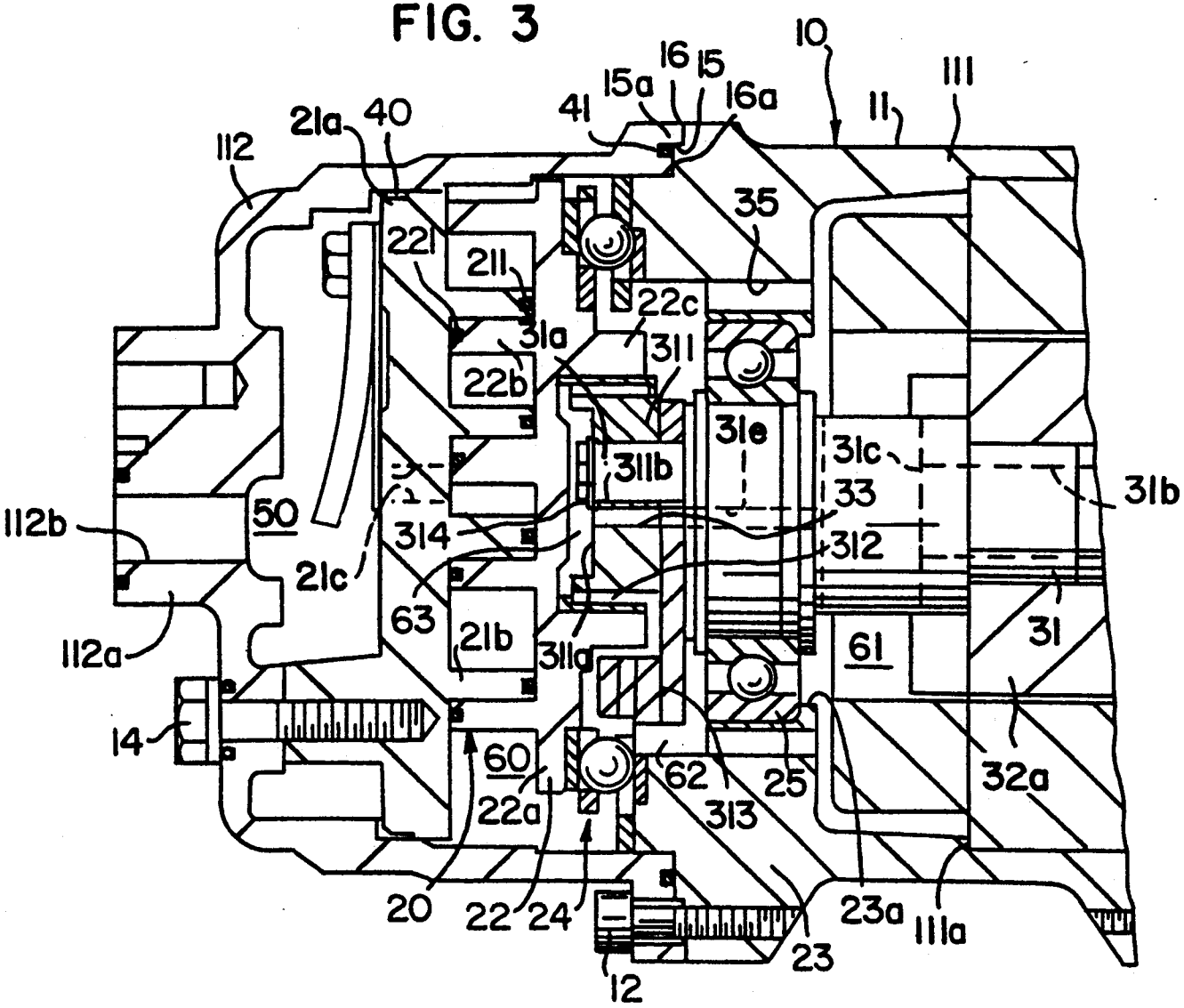
FIG. 3 is an enlarged longitudinal sectional view of a portion of the hermetic type motor driven scroll compressor shown in FIG. 2.

FIGS. 2 and 3 illustrate an overall and partial construction of a hermetic type motor driven scroll compressor in accordance with a first preferred embodiment. For purposes of explanation only, the left side of FIGS. 2 and 3 will be referred to as the forward end or front of the compressor and the right side of FIGS. 2 and 3 will be referred to as the rearward end or rear of the compressor. Further, in FIGS. 2 and 3, elements similar to those shown in FIG. 1 are accorded like numerals with respect to FIG. 1 and the description of some of the identical elements is substantially omitted. Therefore, only features or aspects related to the first preferred embodiment are described in detail below.

Referring to FIGS. 2 and 3, a drive mechanism 30 of the hermetic type motor driven scroll compressor 10 includes drive shaft 31 having second axial bore **31*e* which is formed through a front end portion of drive shaft 31. One end of second axial bore 31*e* is open at the front terminal end of first axial bore 31*b*. The other end of second axial bore 31*e* is open at a front end surface of drive shaft 31. The diameter of second axial bore 31*e* is smaller than the diameter of first axial bore 31*b*, but the longitudinal axis of first axial bore 31*b* is preferably substantially collinear with that of the second axial bore 31*e***.

A passage 33 is axially formed through balance weight 313 and bushing 311. One end of passage 33 is open at a rear end surface of balance weight 313, and faces the open end of second axial bore **31*e*. The other end of passage 33 is open at a bottom surface of shallow depression 311*a* of bushing 311. Accordingly, passage 33 axially extends from the rear end surface of balance weight 313 and is open at the bottom surface of shallow depression 311*a* of bushing 311. The diameter of passage 33 is preferably substantially equal to the diameter of second axial bore 31*e*, and the longitudinal axis of passage 33 is preferably substantially aligned with the longitudinal axis of second axial bore 31*e*. Therefore, second axial bore 31*e* and passage 33** jointly form a single axial bore.

In operation, a refrigerant fluid flowing from an outlet of one external element (not shown), e.g., an evaporator, is conducted into axial hole **113*c* and then flows through first axial bore 31*b* of drive shaft 31. A portion of the refrigerant fluid in first axial bore 31*b* flows into first suction chamber section 61 through at least one radial bore 31*c* (in this embodiment, a plurality of radial bores 31*c* are provided as shown in FIG. 2) and then further flows to second suction chamber section 62 through holes 35 in inner block 23. The remainder of the refrigerant fluid in first axial bore 31*b* of drive shaft 31 flows through second axial bore 31*e* and passage 33, and then flows into a hollow space 63 which is defined by circular end plate 22*a* of orbiting scroll 22, annular projection 22*c* and bushing 311. A portion of the refrigerant fluid in hollow space 63 flows to second suction chamber section 62 past the internal gaps of radial needle bearing 312, and the gaps created between radial needle bearing 312 and annular projection 22*c* and between radial needle bearing 312 and bushing 311. Therefore, the internal frictional surfaces between radial needle bearing 312 and annular projection 22*c* and the frictional surfaces between radial needle bearing 312 and bushing 311 are lubricated by a lubricant, for example, a lubricating oil which is suspended in the refrigerant fluid in a mist state. The remainder of the refrigerant fluid in hollow space 63 flows into second suction chamber section 62 through the small air gaps created between snap ring 314 and bushing 311, between pin member 31*a* and bushing 311, between bushing 311 and balance weight 313, and between balance weight 313 and the front end surface of drive shaft 31. Therefore, the frictional surfaces between snap ring 314 and bushing 311 and between pin member 31*a* and bushing 311** are lubricated.

The refrigerant fluid flowing through radial bores **31*c* and the refrigerant fluid flowing through second axial bore 31*e* and passage 33 are merged at second suction chamber section 62, and then are taken past the rotation prevention mechanism 24, then into the outer sealed-off fluid pockets defined by the fixed and orbiting scrolls 21 and 22. Therefore, the internal frictional surfaces of rotation preventing mechanism 24 is lubricated by the lubricating oil which is suspended in the refrigerant fluid in a mist state. The refrigerant fluid taken into the outer sealed off fluid pockets travels centrally with decreasing volume thereof, e.g., with compression thereof, in accordance with the orbital motion of orbiting scroll 22. The compressed refrigerant fluid is then discharged into discharge chamber 50 through valved discharge port 21*c* of circular end plate 21*a* of fixed scroll 21. The refrigerant fluid in discharge chamber 50 flows through axial hole 112*b*** to an inlet of another external element of the air conditioning system (not shown), e.g., a condenser.

According to the hermetic type motor driven scroll compressor in accordance with the first preferred embodiment, second axial bore **31*e* and passage 33, which jointly form a single axial bore, axially extend from the front terminal end of first axial bore 31*b* such that the longitudinal axes of second axial bore 31*e* and passage 33 are aligned with the longitudinal axis of first axial bore 31*b*. Therefore, the refrigerant fluid can efficiently flow from the first axial bore 31*b* to the second axial bore 31*e* and through passage 33 during operation of the compressor. Accordingly, a relatively large amount of the lubricating oil which is suspended in the refrigerant fluid in a mist state is conducted into hollow space 63 through second axial bore 31*e* and passage 33. As a result, an effective lubrication to the frictional surfaces between bushing 311 and the elements associated with the bushing 311, such as pin member 31*a* and radial needle bearing 312** is carried out during operation of the compressor.

Figure 4:
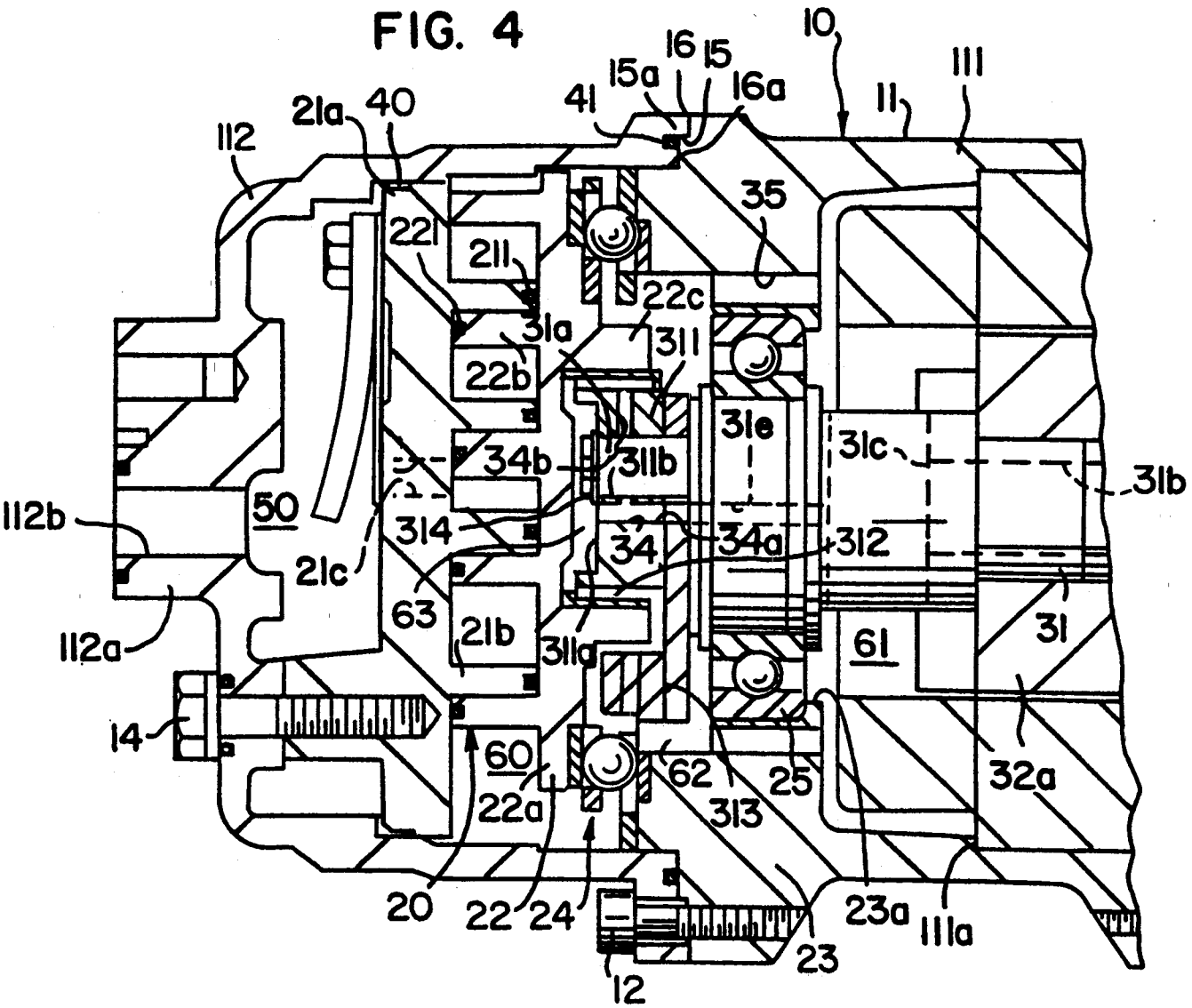
FIG. 4 is a view similar to FIG. 3 illustrating a portion of a hermetic type motor driven scroll compressor according to a second preferred embodiment.

FIG. 4 illustrates a partial construction of a hermetic type motor driven scroll compressor in accordance with a second preferred embodiment. For purposes of explanation only, the left side of FIG. 4 will be referred to as the forward end or front of the compressor and the right side of FIG. 4 will be referred to as the rearward end or rear of the compressor. Further, in FIG. 4, elements similar to those shown in FIG. 1 are accorded like numerals with respect to FIG. 1 and the description of some of the identical elements is substantially omitted. Therefore, only features or aspects related to the second preferred embodiment are described in detail below.

Referring to FIG. 4, a passage 34 having an axial straight portion 34*a* and at least one radial straight portion 34*b* is formed through balance weight 313 and bushing 311. One end of axial straight portion 34*a* of passage 34 is open at a rear end surface of balance weight 313, and faces the from open end of second axial bore 31*e*. The other end of axial straight portion 34*a* of passage 34 terminates at a position adjacent to but before the bottom surface of shallow depression 311*a* of bushing 311. The diameter of axial straight portion 34*a* of passage 34 is preferably substantially equal to the diameter of second axial bore 31*e*, and the longitudinal axis of axial straight portion 34*a* of passage 34 is preferably substantially aligned with the longitudinal axis of the second axial bore 31*e*. Therefore, second axial bore 31*e* and axial straight portion 34*a* of passage 34 jointly form a single axial bore.

At least one radial straight portion 34*b* radially extends from the front end of axial straight portion 34*a* of passage 34 and is, past axial hole 311*b*, open at an outer peripheral surface of bushing 311. The diameter of radial straight portion 34*b* of passage 34 is preferably designed to be substantially equal to the diameter of axial straight portion 34*a* of passage 34.

According to the second preferred embodiment, substantially all of the refrigerant fluid flowing through passage 34 is directly conducted past axial hole 311*b* of bushing 311 and into the gap created between radial needle bearing 312 and bushing 311. As a result, the frictional surfaces between bushing 311 and radial needle bearing 312 and between bushing 311 and pin member 31*a* are effectively and sufficiently lubricated by the lubricating oil which is suspended in the refrigerant fluid in a mist state. The other effects and operational manner of the compressor according to the second preferred embodiment are similar to those of the first preferred embodiment so that an explanation thereof is omitted.

Although this invention has been described in detail in connection with the preferred embodiments, the description is merely for example purposes only and the scope of the present invention is not restricted thereto. It will be understood by those of ordinary skill in the art that other variations and modifications can be easily made within the scope of this invention as defined by the appended claims.

I claim:

1. In a hermetic motor driven scroll apparatus comprising a housing having a fluid inlet port and a fluid outlet port;

a compression mechanism disposed within said housing, said compression mechanism including a fixed scroll fixedly disposed within said housing and having a first end plate from which a first spiral element extends and an orbiting scroll having a second end plate from which a second spiral element extends, said first and second spiral elements interfitting at an angular and radial offset to make a plurality of line contacts to define at least one pair of sealed off fluid pockets;

a drive mechanism disposed within said housing, said drive mechanism comprising a drive shaft having a first axial end and a second axial end opposite to said first axial end, the first axial end of said drive shaft positioned adjacent to said fluid inlet port, said drive shaft rotatably supported by said housing, said drive mechanism further comprising a crank pin eccentrically extending from said second axial end of said drive shaft and a bushing having an axial hole into which said crank pin is rotatably received, said bushing operatively connecting said crank pin to said orbiting scroll, said orbiting scroll being moved by said bushing in orbital motion, said drive mechanism still further comprising a motor rotating said drive shaft;

rotation preventing means for preventing the rotation of said orbiting scroll during orbital motion thereof;

said drive shaft including a first axial bore formed therethrough, a first end of said first axial bore terminating at the first axial end of said drive shaft, a second end of said first axial bore opening at a position adjacent to said second axial end of said drive shaft, said first axial bore including a longitudinal axis, said drive shaft further including at least one radial bore radially extending from the second end of said first axial bore and opening at an outer peripheral surface of said drive shaft;

said drive shaft still further including a second axial bore which includes a longitudinal axis and extends from the second end of said first axial bore and is open at an axial end surface of said second axial end of said drive shaft wherein the longitudinal axis of said first axial bore is substantially collinear with the longitudinal axis of said second axial bore;

said bushing further including a first axial end and a second axial end opposite to the first axial end and a passage formed therein, the second axial end of said bushing facing the second axial end of said drive shaft, said passage including an axial straight portion having a longitudinal axis, one end of said axial straight portion of said passage being open at the second axial end of said bushing; wherein the longitudinal axis of said axial straight portion of said passage is substantially aligned with the longitudinal axis of said second axial bore.

2. The hermetic motor driven scroll apparatus of claim 1 wherein the diameter of said second axial bore is smaller than the diameter of said first axial bore.

3. The hermetic motor driven scroll apparatus of claim 1 wherein the diameter of said second axial bore is substantially equal to the diameter of said axial straight portion of said passage.

4. The hermetic motor driven scroll apparatus of claim 1 wherein said axial straight portion of said passage is in fluid communication with said first axial end of said bushing.

5. The hermetic motor driven scroll apparatus of claim 4 wherein said axial straight portion of said passage extends from said second axial end to said first axial end of said bushing.

6. The hermetic motor driven scroll apparatus of claim 1 wherein the longitudinal axis of said second axial bore is aligned with the longitudinal axis of said first axial bore.

7. The hermetic motor driven scroll apparatus of claim 1 wherein the first end of said axial straight portion of said passage terminates at a position adjacent to said first axial end of said bushing and wherein said passage further includes at least one radial straight portion which radially extends from the first end of said axial straight portion of said passage through said axial hole formed in said bushing and terminates at an outer peripheral surface of said bushing.

8. The hermetic motor driven scroll apparatus of claim 7 wherein the diameter of said straight portion of said passage is substantially equal to the diameter of said at least one radial straight portion of said passage.

9. The hermetic motor driven scroll apparatus of claim 1 wherein a balance weight is fixedly disposed on an extension of said second axial end of said bushing for averaging the torque of said drive shaft during rotation thereof.

10. The hermetic motor driven scroll apparatus of claim 9 wherein said axial straight portion of said passage extends through said balance weight.

* * * * *